US005151143A

United States Patent [19]

Downie

[11] Patent Number: 5,151,143

[45] Date of Patent: Sep. 29, 1992

[54] MOISTURE-IMPERMEABLE ELECTRIC CONDUCTOR

[75] Inventor: Ian Downie, Brockville, Canada

[73] Assignee: Bicc plc, England

[21] Appl. No.: 703,887

[22] Filed: May 22, 1991

[30] Foreign Application Priority Data

May 30, 1990 [GB] United Kingdom ..... 9012062

[51] Int. Cl.[5] ..... H01B 13/32

[52] U.S. Cl. ..... 156/48; 156/51; 174/23 R; 174/24; 174/120 SC

[58] Field of Search ..... 174/120 SC, 23 R, 24, 174/120 R, 23 C; 156/48, 51

[56] References Cited

U.S. PATENT DOCUMENTS

| | | | |
|---|---|---|---|
| 2,698,353 | 12/1954 | Carr et al. | 174/24 |
| 3,589,121 | 6/1971 | Mulvey | 156/51 X |
| 3,615,959 | 10/1971 | Nance | 156/48 X |
| 4,125,741 | 11/1978 | Wahl et al. | 174/120 SC |
| 4,407,854 | 10/1983 | Pan | 156/48 X |
| 4,435,613 | 3/1984 | Gaubert | 174/23 C |
| 4,791,240 | 12/1988 | Marin et al. | 174/23 C |
| 4,963,645 | 10/1990 | Marciano-Agostinelli et al. | 174/23 C |

FOREIGN PATENT DOCUMENTS 1139169 11/1962 Fed. Rep. of Germany ..... 156/48

*Primary Examiner*—Morris H. Nimmo

*Attorney, Agent, or Firm*—Anthony J. Casella; Gerald E. Hespos

[57] ABSTRACT

In the manufacture of a cable core comprising a moisture-impermeable multi-wire conductor, the conductor is stranded in a conventional manner and, after a fluid-impermeable layer of plastics material has been extruded over the conductor to form the core, the core is wound around the hub of a cable drum in such a way that each end of the wound core is exposed and accessible. One exposed end of the wound core is sealed and air is evacuated from the conductor interstices by a vacuum pump cemented to the other exposed end of the wound core. A source of semi-conductive moisture-impermeable compound in a liquid or semi-liquid state is then connected to the exposed end of the wound core and moisture-impermeable compound is drawn into and flows along the evacuated conductor interstices until the interstices are filled throughout the length of the core. The moisture-impermeable compound in the interstices is then permitted to solidify or thicken to such an extent that it will not readily flow from the conductor.

14 Claims, 1 Drawing Sheet

MOISTURE-IMPERMEABLE ELECTRIC CONDUCTOR

Figure 1:
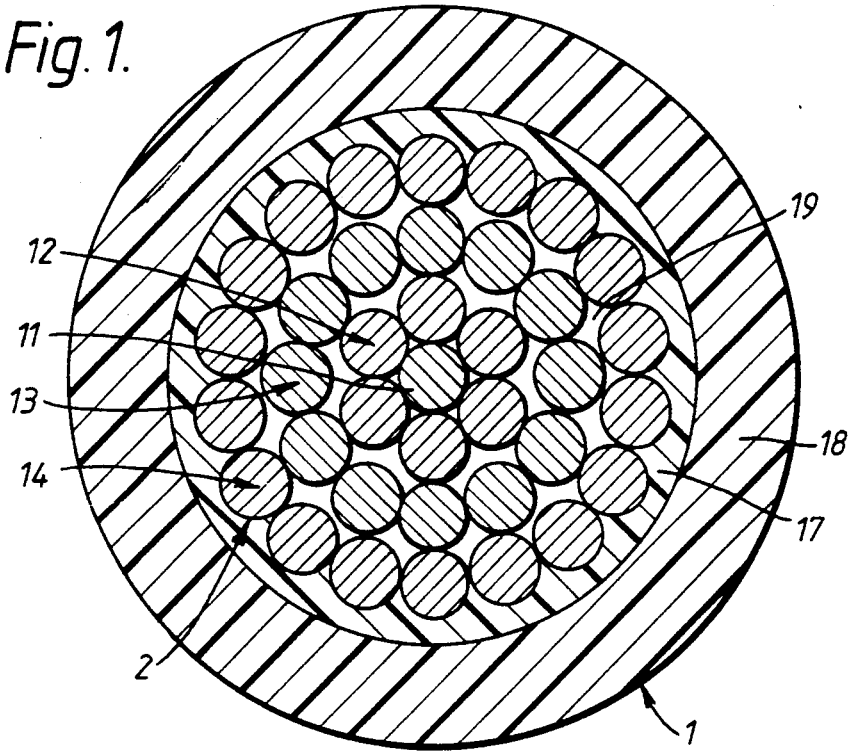

This invention relates to electric cables of the kind having one or more than one electric conductor comprising a plurality of wires or other flexible elongate elements of metal or metal alloy stranded or otherwise assembled together, the or each conductor being surrounded by at least one extruded layer of plastics material. For convenience, all such flexible elements of metal or metal alloy hereinafter will be included in the generic term "wires". The plastics material of the extruded layer immediately adjacent the outermost layer of wires of the or each conductor substantially fills interstices between the wires of the outermost layer of wires and is usually, but not necessarily, semi-conductive because it is the normal practice for the extruded layer of plastics material immediately adjacent the conductor to constitute a conductor screen.

With a view to substantially reducing risk of moisture penetration along interstices within a conductor consisting of a plurality of wires stranded or otherwise assembled together, it is common practice for the interstices wholly bounded by the wires of the conductor to be substantially filled with a semi-conductive moisture-impermeable compound throughout substantially the whole length of the conductor.

It is an object of the present invention to provide an improved method of manufacturing an electric cable comprising at least one cable core having a substantially moisture-impermeable multi-wire electric conductor, which method of manufacture is simple and substantially less expensive than methods of manufacture hitherto proposed and used.

According to the invention, the improved method comprises causing a flexible elongate core of metal or metal alloy to travel continuously in the direction of its length; helically winding around the advancing metal core at least one layer of wires to form a flexible multi-wire conductor; extruding over the multi-wire conductor at least one fluid-impermeable layer of plastics material to form an electric cable core; winding the cable core around the hub of a cable drum in such a way that each end of the wound cable core is exposed and accessible; sealing the end of the multi-wire conductor at one exposed end of the wound cable core and evacuating air from the interstices bounded by the wires of the multi-wire conductor from the other exposed end of the wound cable core; connecting a source of semi-conductive moisture-impermeable compound in a liquid or semi-liquid state to the end of the multi-wire conductor at one exposed end of the wound cable core and filling the interstices with moisture-impermeable compound by allowing moisture-impermeable compound to be drawn into and to flow along the interstices throughout the length of the multi-wire conductor until the interstices are substantially filled throughout the length of the conductor and permitting or causing the moisture-impermeable compound in said interstices to thicken or solidify to such an extent that it will not readily flow from the conductor.

Where the electric cable core is to constitute the core of a single core electric cable, preferably, before the cable core is wound around the hub of the cable drum, the cable sheath and any other protective layer are applied to the cable core.

Where the electric cable core is to constitute one core of a multi-core electric cable, preferably, before the cable core is wound around the hub of a cable drum, the cable cores are laid-up or otherwise assembled together, a cable sheath and any other protective layer are applied to the assembled cores to form a multi-core electric cable and the electric cable is wound around the hub of the cable drum. The multi-wire conductors of the cable cores of the wound multi-core cable may be evacuated and moisture-impermeable compound in a liquid or semi-liquid state drawn into the evacuated interstices of the multi-wire conductors concurrently, or the multi-wire conductors may be evacuated and filled with moisture-impermeable compound independently and in turn.

Preferably, in all cases, semi-conductive, moisture-impermeable compound in a liquid or semi-liquid state is not permitted to be drawn into the interstices of the multi-wire conductor or conductors of the wound core or cores until substantially all air has been evacuated from the interstices, thereby substantially reducing the risk of formation of any air pockets within the semi-conductive, moisture-impermeable compound-filled interstices of the or each multi-wire conductor.

In some circumstances, before semi-conductive moisture-impermeable compound in a liquid or semi-liquid state is drawn into the interstices of the multi-wire conductor or conductors of the wound core or cores, the conductor of the or each core is heated with a view to preventing premature cooling and thickening of the compound being drawn into the interstices before the interstices of the conductor are substantially filled through the length of the conductor. Such heating may be effected before, during or after evacuating air from the interstices and is preferably achieved by passing an appropriate current along the conductor.

Evacuation of air from the interstices of the multi-wire conductor of the or each wound cable core may be effected at either exposed end of the wound cable core but, preferably, it is effected at the exposed leading end of the wound cable core and, for this purpose, preferably the leading end of the wound cable core, that is to say the end of the wound cable core nearer the hub of the cable drum, protrudes through a hole in a flange of the cable drum. Evacuation of air preferably is effected by means of a vacuum pump which can be detachably connected to the end of the multi-wire conductor at an exposed end of the wound cable core and which, preferably, incorporates means for temporarily sealing the end of the conductor with respect to the vacuum pump.

Preferably, a source of said semi-conductive, moisture-impermeable compound in a liquid or semi-liquid state is detachably connected to the end of the conductor at the exposed trailing end of the wound cable core and, preferably also, a temporary seal is effected between the conductor and the source whilst the interstices of the conductor are being evacuated. The source of semi-conductive, moisture-impermeable compound preferably is heated to maintain compound in the source at such a temperature that the compound is in said liquid or semi-liquid state.

As the semi-conductive, moisture-impermeable compound, it is preferred to employ a compound which, when heated to a temperature above approximately 150° C., is sufficiently liquefied for the compound to be drawn into evacuated interstices of a multi-wire conductor of a wound cable core and which, when permitted to cool to a temperature below approximately 130°

C., will thicken or solidify to such an extent that the compound will not readily flow from the conductor.

The elongate metal core around which at least one layer of wires is helically wound may be a single central wire or it may comprise a plurality of wires stranded together.

The invention further includes an electric cable comprising at least one cable core having a multi-wire conductor, wherein the interstices of the multi-wire conductor of the or each core have been filled with semi-conductive, moisture-impermeable compound by the improved method hereinbefore described.

By virtue of the improved method of the present invention, semi-conductive, moisture-impermable compound is not introduced into the interstices of the multi-wire conductor of the or each cable core of an electric cable until after manufacture of the cable has been completed and need not be introduced until after electrical testing of the cable has been carried out.

Figure 2:
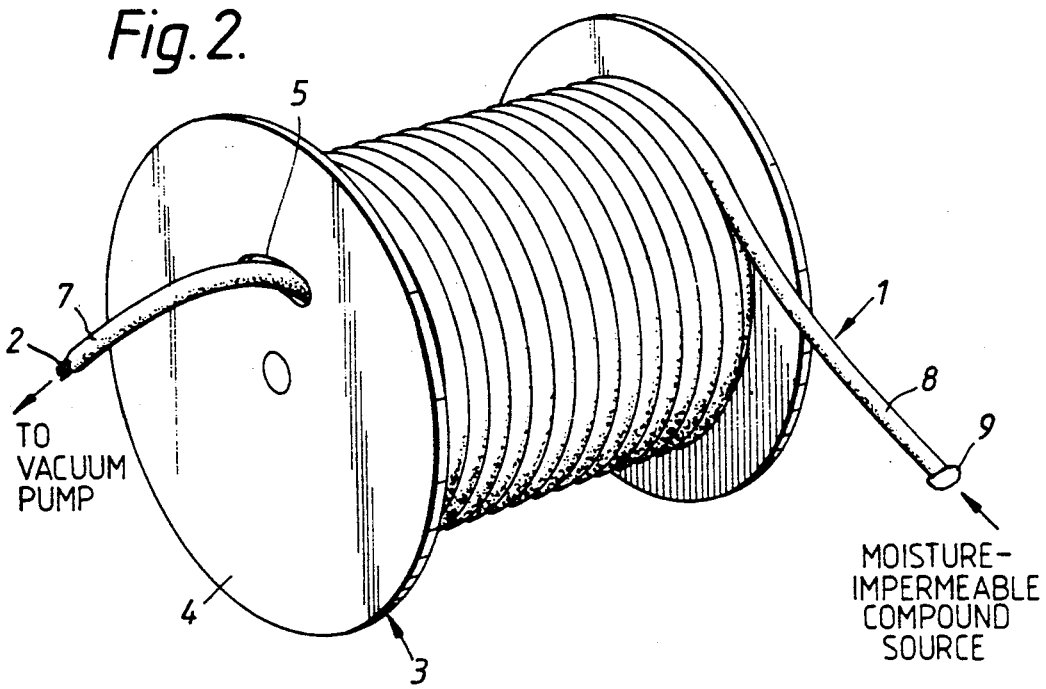

The invention is further illustrated by a description, by way of example, of the preferred method of manufacturing a single core electric cable comprising a cable core having a substantially moisture-impermeable multi-wire electric conductor with reference to the accompanying drawings in which:

FIG. 1 shows a diagrammatic transverse cross-sectional view of the single core electric cable, and FIG. 2 shows a diagrammatic perspective view of the final steps of the method.

The initial steps in the manufacture of the single core electric cable are conventional in the electric cable manufacturing industry and require no detailed description or illustration. These steps comprise causing a single central copper wire 11 to travel continuously in the direction of its length; helically winding around the advancing wire 11 a layer 12 of copper wires and helically winding around the last-applied layer 12 of copper wires at least one additional layer 13, 14 . . . of copper wires to form a flexible multi-wire conductor 2; extruding over the multi-wire conductor 2 at least one fluid-impermeable layer 17 of plastics material to form an electric cable core; and applying to the cable core an overall protective sheath 18 to form a sheath cable core 1. A diagrammatic transverse cross-sectional view of the single core electric cable 1 is shown in FIG. 1. Thereafter, as illustrated diagrammatically in FIG. 2, the sheathed cable core 1 is wound around the hub of a cable drum 3 in such a way that the leading end 7 of the sheathed cable core protrudes through a hole 5 in a flange 4 of the drum so that the end of the multi-wire conductor 2 at the leading end of the sheathed cable core is exposed and accessible. The end of the multi-wire conductor 2 at the trailing end 8 of the sheathed cable core 1 is then sealed at 9, a vacuum pump (not shown) is detachably connected to the end of the multi-wire conductor 2 at the leading end 7 of the sheathed cable core and air is evacuated from the interstices 19 (FIG. 1) bounded by the wires of the multi-wire conductor of the wound sheathed cable core. After evacuation of air from the multi-wire conductor 2 of the wound cable core 1 has been effected, the vacuum pump is disconnected from, or sealed with respect to, the end of the multi-wire conductor at the leading end 7 of the wound sheathed cable core and a source of semi-conductive moisture-impermeable compound (not shown) heated to maintain the compound in a liquid state is connected to the end of the multi-wire conductor at the trailing end 8 of the wound sheathed cable core. Moisture-impermeable compound in a liquid state is allowed to be drawn into and along the interstices of the multi-wire conductor 2 of the wound sheathed cable core 1 until the interstices 19 are filled throughout the length of the multi-wire conductor and , thereafter, the source of semi-conductive moisture-impermeable compound is disconnected from the trailing end 8 of the wound sheathed cable core and the moisture-impermeable compound filling the interstices of the multi-wire conductor 2 is permitted to thicken or solidify to such an extent that it will not readily flow from the conductor.

What I claim as my invention is:

1. A method of manufacturing an electric cable comprising at least one cable core having a substantially moisture-impermeable multi-wire electric conductor, which method comprises causing a flexible elongate core of metal or metal alloy to travel continuously in the direction of its length; helically winding around the advancing metal core at least one layer of wires to form a flexible multi-wire conductor; extruding over the multi-wire conductor at least one fluid-impermeable layer of plastics material to form an electric cable core; winding the cable core around the hub of a cable drum in such a way that each end of the wound cable core is exposed and accessible; sealing the end of the multi-wire conductor at one exposed end of the wound cable core and evacuating air from the interstices bounded by the wires of the multi-wire conductor from the other exposed end of the wound cable core; connecting a source of semi-conductive moisture-impermeable compound in a liquid or semi-liquid state to the end of the multi-wire conductor at one exposed end of the wound cable core and filling the interstices with moisture-impermeable compound by allowing moisture-impermeable compound to be drawn into and to flow along the interstices throughout the length of the multi-wire conductor until the interstices are substantially filled throughout the length of the conductor and permitting or causing the moisture-impermeable compound in said interstices to thicken to such an extent that it will not readily flow from the conductor.

2. A method as claimed in claim 1 in which the electric cable core is to constitute the core of a single core electric cable, wherein before the cable core is wound around the hub of the cable drum, the method further comprises applying a cable sheath to the cable core.

3. A method as claimed in claim 1 in which the electric cable core is to constitute one core of a multi-core electric cable, wherein, before the cable core is wound around the hub of the cable drum, the method further comprises laying-up the cable core with at least one other cable core of similar construction, applying a cable sheath to the assembled cores to form a multi-core electric cable, and winding the electric cable around the hub of the cable drum.

4. A method as claimed in claim 3, wherein the method further comprises evacuating the multi-wire conductors of the cable cores of the wound multi-core cable and drawing moisture-impermeable compound in a liquid or semi-liquid state into the evacuated interstices of the multi-wire conductors concurrently.

5. A method as claimed in claim 1, wherein the method further comprises evacuating substantially all air from the interstices of the multi-wire conductor during the evacuating step.

6. A method as claimed in claim 1, wherein, before semi-conductive moisture-impermeable compound in a liquid or semi-liquid state is drawn into the interstices of the conductor, the method further comprises heating the multi-wire conductor of the wound core to prevent premature cooling and thickening of the compound as it is being drawn into the interstices.

7. A method as claimed in claim 6, wherein said heating is effected by passing an appropriate current along the conductor.

8. A method as claimed in claim 1, wherein the method further comprises evacuating air from the interstices of the multi-wire conductor of the wound cable core at the exposed leading end of the wound cable core.

9. A method as claimed in claim 8, wherein the method further comprises feeding the leading end of the wound cable core through a hole in a flange of the cable drum so that the leading end of the wound cable core protrudes therethrough.

10. A method as claimed in claim 1, wherein the method further comprises detachably connecting a vacuum pump to the end of the multi-wire conductor at the exposed end of the wound cable core, which vacuum pump incorporates means for temporarily sealing the end of said multi-wire conductor with respect to the vacuum pump, and evacuating air from the interstices of the multi-wire conductor of the wound cable core by means of said vacuum pump.

11. A method as claimed in claim 1, wherein the method further comprises detachably connecting to the end of said multi-wire conductor at the exposed trailing end of the wound cable core a source of said semi-conductive, moisture-impermeable compound in a liquid or semi-liquid state.

12. A method as claimed in claim 11, wherein the method further comprises effecting a temporary seal between said multi-wire conductor and the source of semi-conductive, moisture-impermeable compound whilst the interstices of said conductor are being evacuated.

13. A method as claimed in claim 11, wherein the method further comprises heating the source of semi-conductive, moisture-impermeable compound to maintain compound in the source at such a temperature that the compound is in said liquid or semi-liquid state.

14. A method as claimed in claim 1, wherein the method further comprises selecting a semi-conductive, moisture-impermeable compound which, when heated to a temperature of above approximately 150° C., is sufficiently liquified for the compound to be drawn into evacuated interstices of said multi-wire conductor of the wound cable core and which, when permitted to cool to a temperature below approximately 130° C., thickens to such an extent that the compound will not readily flow from the conductor.

* * * * *